US005299502A

United States Patent [19]

Maki

[11] Patent Number: 5,299,502

[45] Date of Patent: Apr. 5, 1994

[54] CONTAINER FOR SHOT OF SHOTSHELL

[76] Inventor: Nagatoshi Maki, 2-48-4, Kamiishihara, Chofu-shi, Tokyo, Japan

[21] Appl. No.: 943,109

[22] Filed: Sep. 10, 1992

Related U.S. Application Data

[62] Division of Ser. No. 694,135, May 1, 1991, abandoned.

[30] Foreign Application Priority Data

Nov. 29, 1989 [JP] Japan ..... 1-307525
Apr. 10, 1991 [JP] Japan ..... 3-103590

[51] Int. Cl.[5] ..... F42B 7/02
[52] U.S. Cl. ..... 102/457; 102/449
[58] Field of Search ..... 102/448–463, 102/532

[56] References Cited

U.S. PATENT DOCUMENTS

| | | | |
|---|---|---|---|
| 1,864.916 | 6/1932 | Gachassin-Lafite | 102/449 |
| 3,074,344 | 1/1963 | Devaux | 102/454 |
| 3,368.489 | 2/1968 | Herter | 102/451 |
| 3,487,779 | 1/1970 | Hendricks | 102/453 |
| 3,618,246 | 11/1971 | Woodring | 102/448 |
| 3,623,431 | 11/1971 | Hendricks | 102/450 |
| 3,720.171 | 3/1973 | Hubbard | 102/451 |
| 3,835,783 | 9/1974 | Curran | 102/451 |
| 4,167,904 | 9/1979 | Ferri | 102/457 |
| 4,506.605 | 3/1985 | Maki . | |
| 4,635,555 | 1/1987 | Ferri | 102/453 |
| 4,669.385 | 6/1987 | Maki . | |
| 4,676,169 | 6/1987 | Maki . | |
| 4,779,535 | 10/1988 | Maki . | |

FOREIGN PATENT DOCUMENTS

| | | | |
|---|---|---|---|
| 201048 | 6/1983 | Fed. Rep. of Germany | 102/449 |
| 1186659 | 8/1959 | France | 102/449 |
| 2076182 | 10/1971 | France | 102/532 |
| 43-15156 | 6/1968 | Japan . | |
| 715920 | 2/1980 | U.S.S.R. | 102/449 |
| 1118846 | 10/1984 | U.S.S.R. | 102/457 |
| 1352169 | 11/1987 | U.S.S.R. | 102/532 |
| 896 | of 1878 | United Kingdom | 102/449 |
| 1427721 | 3/1976 | United Kingdom | 102/449 |

OTHER PUBLICATIONS

USSN 416468 corresponding to JPP' 156.

*Primary Examiner*—Harold J. Tudor
*Attorney, Agent, or Firm*—Merchant, Gould, Smith, Edell, Welter & Schmidt

[57] ABSTRACT

A container of shot for a shotshell includes a container body comprised of a non-slit tube and a disc integral therewith and in contact with a wad. The disc is coaxial to the non-slit tube. The disc and the non-slit tube have a diameter slightly smaller than a bore of an associated shotgun. The container has an open hollow portion defined by an inner peripheral surface of the non-slit tube and an end face of the disc, and further includes a retarder provided in the container body to retard the separation of the shot pellets from the container. The container can be advantageously used with a shotshell having steel shot pellets charged therein.

1 Claim, 4 Drawing Sheets

CONTAINER FOR SHOT OF SHOTSHELL

This is a divisional of application Ser. No. 07/694,135, filed May 1, 1991 now abandoned.

BACKGROUND OF THE INVENTION

1. Field of the Invention

The present invention relates to an improved container for shot of a shotshell used in target shooting, hunting or the like.

2. Description of the Related Art

A special shotshell which, when fired from a shotgun barrel having a slight degree of choke, such as an improved cylinder or a skeet choke, provides a dense pattern comparable to a pattern provided by a conventional shotshell charge fired from a modified choked barrel of a shotgun, is not now available on the market.

Accordingly, a shotgun having a slight degree of choke can be used only for short range shooting, and to obtain a more effective and longer range shooting, using such a shotgun, the barrel must be replaced with an extra barrel or an interchangeable choke or an adjustable choke attached to the muzzle of the barrel. Such a replacement or attachment and detachment is troublesome and expensive.

FIG. 9 shows a known shotshell, by way of example, having a case 2 set in a metal base 2A provided, on an end portion 1 thereof, with a pressed-in primer (not shown). The case 2 contains powder 3, a wad 11, composed of a cup wad 4 and a filler wad 5, a shot cup 6, and shot 7, charged in this order. These elements are charged in the case 2 and secured therein by a crimp 15 constituted by a disc 8 and a curl 9, which defines an open end of the case 2 and secures the disc 8 to the case 2. The shot cup 6 is made of a disc 6B and a plurality of petals 6A integral therewith and forming a cylinder. The adjacent petals 6A define therebetween slits 10. The petals 6A are deformed outward and spread like a flower in bloom, due to a pressure imposed by an impact thereof with the air immediately after being fired from the muzzle, whereby the shot cup 6 is immediately separated from the shots 7 and falls to the ground, so that it does not become an obstacle to the spread of the shot 7.

The primary object of the present invention is to provide a container of shot of a shotshell, in which a more effective longer range shooting can be obtained merely by exchanging a type of shotshell to be used and without the need to modify the degree of choke.

The container according to the present invention is used instead of the conventional shot cup 6, to ensure that the shot 7 travels while being held within the container for a certain space of time after the shotshell is fired, to thereby realize a longer effective shooting range.

SUMMARY OF THE INVENTION

To achieve the object of the present invention, in a shotshell for a shotgun, including a case in which powder, a wad, a container, and shot pellets contained in the container are charged in this order, wherein the case is crimped at an open end thereof, according to the present invention, the container for containing the shot pellets comprises a container body constituted by a non-slit tube and a disc integral therewith and in contact with the wad, the disc being coaxial to the non-slit tube, and the disc and the non-slit tube both having a diameter slightly smaller than a bore of an associated shotgun to be used. The container body is provided with an open hollow portion defined by an inner peripheral surface of the non-slit tube and an end face of the disc, and a retarder is provided in the container body to retard the separation of the shot pellets from the container.

Namely, with this arrangement, because the separation of the shot pellets from the container is retarded, a longer range shooting with a denser shot pattern can be effectively obtained.

BRIEF DESCRIPTION OF THE DRAWINGS

The invention will be described below in detail with reference to the accompanying drawings, in which.

DESCRIPTION OF THE PREFERRED EMBODIMENTS

Figure 1:
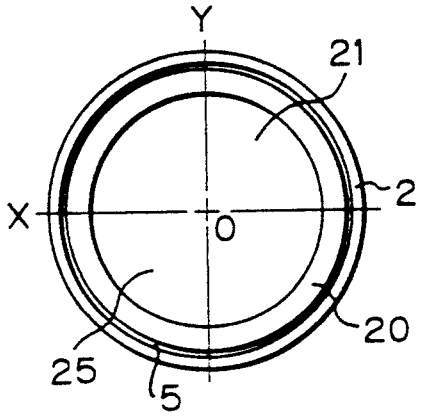
FIG. 1 is a front elevational view of a container according to a first embodiment of the present invention.
Figure 2:
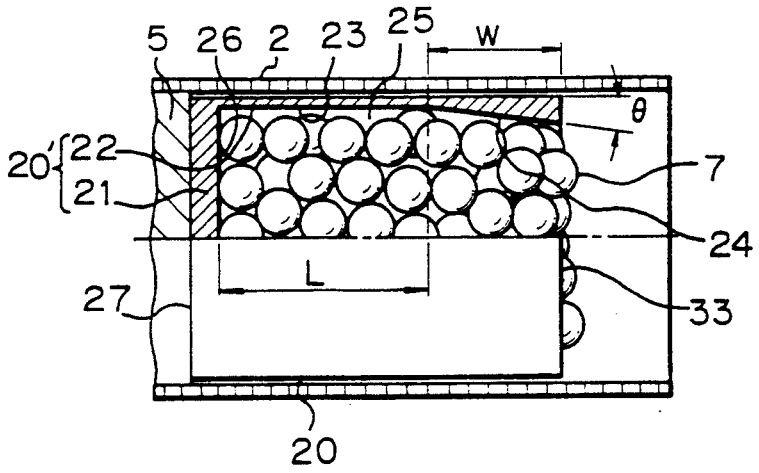
FIG. 2 is a longitudinal sectional view of a container containing shot pellets and charged in a case, according to an embodiment of the present invention, taken along the line X-O-Y in FIG. 1.

FIGS. 1 and 2 show a first embodiment of the present invention, wherein FIG. 1 shows only a container 20 and FIG. 2 shows the container 20 having shot pellets 7 charged therein and held in the case 2, together with a filler wad 5, before the crimp 15 (FIG. 9) is formed.

The container 20 is made of plastic or the like, which tends to produce a residual strain and is shaped so that it can be easily mass-produced by injection molding.

Plastic is understood to mean the material commonly associated with the word as known in the prior art wherein, in *McGraw-Hill Dictionary of Scientific and Technical Terms*, 4th Edition, McGraw-Hill Book Company, New York, N.Y. (1989), a plastic is defined to be "A polymeric material (usually organic) or large molecular weight which can be shaped by flow; usually refers to the final product with fillers, plasticizers, pigments, and stabilizers included (versus the resin, the homogenous polymeric starting material); examples are polyvinyl chloride, polyethylene, and urea-formaldehyde.

The container 20 is in the shape of a tumbler and is constituted by a container body 20', comprised of a cylindrical tube 22 and a circular disc (plate) 21 coaxial thereto and integral therewith. A rear end face 27 of the container body 20' is in surface contact with the filler wad 5. The cylindrical tube 22 has an open front end 33, and in the present invention, a slit which extends from the front end 33 of the tube 22 toward the disc 21 is not provided, unlike the prior art shown in FIG. 9 which the shot cup 6 has slits 10 defined by and between the adjacent petals 6A, as mentioned above. Note, this does not exclude the possibility of a provision of a closed axial slot or slots formed in the tube 22. Namely, in the present invention, the tube 22 is not provided with a slit which is open at the front end 33 thereof.

The outer diameters of the disc 21 and the tube 22 are substantially equal to or slightly smaller than an inner diameter of a bore 13A (FIG. 6) of a barrel 13 of an associated gauge shotgun.

The container body 20' has a cylindrical hollow portion 25 defined by an inner peripheral surface 23 of the tube 22 and a front end face 26 of the disc 21. The tube 22 is provided, on the front end of the inner peripheral surface 23 or in the vicinity thereof, with an annular peripheral projection 24 integral with the tube 22. The annular peripheral projection 24, which has a tapered surface, projects inward into the cylindrical hollow portion 25 in a direction substantially perpendicular to the axis of the tube 22.

In FIG. 2, the axial length (width) and the oblique angle of the annular projection 24 are designated by w and $\theta$, respectively.

Figure 3:
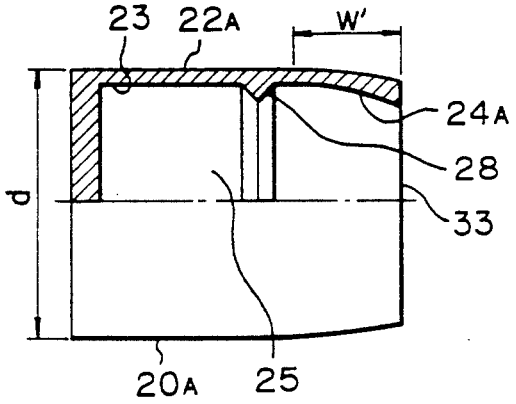
FIG. 3 is a longitudinal sectional view of a container similar to FIG. 2, according to a second embodiment of the present invention.

FIG. 3 shows a second embodiment of a container 20A according to the present invention, in which the inner peripheral surface 23 of the tube 22A is provided with a curved annular peripheral projection 24A and an additional annular peripheral 28 projection 28 having a triangular cross section is located to the rear of the curved annular peripheral projection 24A. The projections 24 A and 28 project inward into the cylindrical hollow portion 25 in a direction substantially perpendicular to the axis of the tube 22A. The outer surface of the tube 22A is smoothly curved at the front end side thereof. In FIG. 3, the axial length (width) of the projection 24A is designated by w'. The remaining construction of the container 20A shown in FIG. 3 is same as that of the container 20 of the first embodiment shown in FIGS. 1 and 2.

Figure 4:
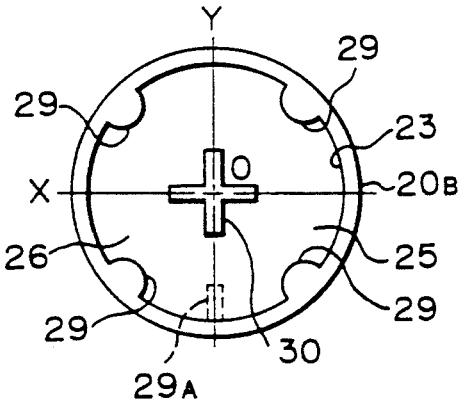
FIG. 4 is a front elevational view of a container, similar to FIG. 1, according to a third embodiment of the present invention.
Figure 5:
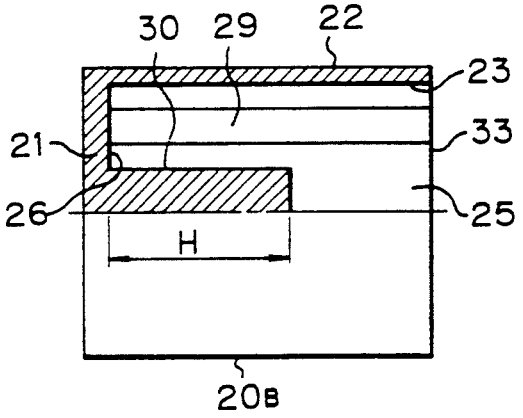
FIG. 5 is a longitudinal sectional view of a container, similar to FIG. 2, taken along the line X-O-Y in FIG. 4.

FIGS. 4 and 5 show a third embodiment of a container 20B according to the present invention. In the third embodiment illustrated in FIGS. 4 and 5, the inner peripheral surface 23 of the container 20B is provided with a plurality of (e.g., four) ribs 29 which extend in parallel with the axis of the tube 22 and which have a semi-circular cross section. These ribs 29 project into the cylindrical hollow portion 25 of the tube 22. Also, a post 30 is provided on the disc 21 and integral therewith, and extends from the front end face 26 of the disc 21 in the cylindrical hollow portion 25, coaxially to the axis of the tube 22. The post 30 is made of a plurality of (e.g., four) integral rectangular plates (blades). As shown in FIG. 5, "H" designate the axial length (height) of the post 30.

Namely, in the third embodiment illustrated in FIG. 5, two different projections, i.e., the ribs 29 and the post 30, are provided in the cylindrical hollow portion 25 of the tube 22, and integral therewith. The shapes of the ribs 29 and the post 30 are not limited to those of the illustrated embodiment; for example, the ribs 29 can be in the form of rectangular plates 29A, as shown by an imaginary line in FIG. 4, or the post 30 can have any polygonal or curved shape in cross section.

The operations of the first, second and third embodiments described above are explained as follows.

The container 20 having shot pellets 7 charged therein is accelerated from the stationary state to a transonic speed faster than the speed of sound within an extremely short space of time, on the order of $10^{-3}$ seconds, by the explosion of the powder 3. Consequently, the shot pellets 7, which are made of a lead-based alloy, and accordingly, have a large mass, are subject to an extreme acceleration in the barrel, and exhibit a very high resistance to the acceleration, i.e., a large inertial resistance (drag).

Figure 6:
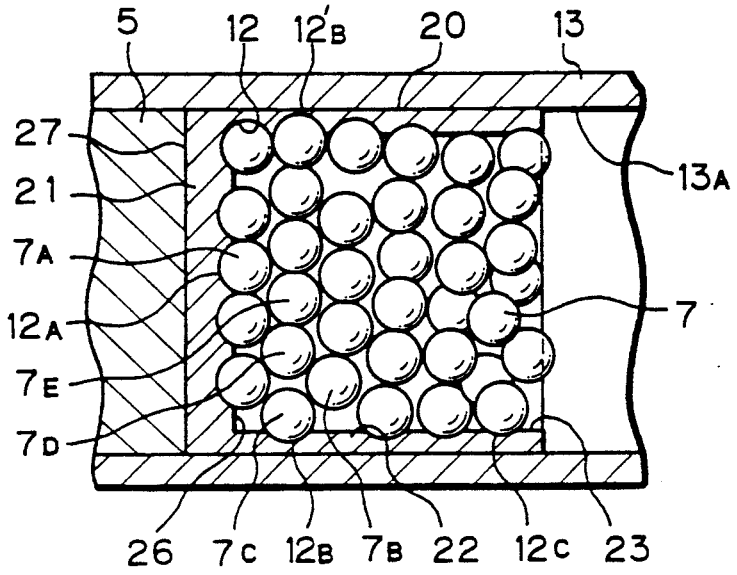
FIG. 6 is an enlarged sectional view of a container charged a barrel, taken along a longitudinal axis thereof, for explaining how shot pellets charged in the container act on the container, when accelerated in the barrel according to the present invention.

FIG. 6 shows an action of the shot pellets 7 on the container 20, while being accelerated in the barrel 13. Note,, in FIG. 6, numerals 5 and 13A designate the filler wad and the barrel bore, respectively. Also, in FIG. 6, the projections (24, 24A, etc.) are omitted from the illustration, for clarification.

1) Since the disc 21 is forcibly accelerated at a very high acceleration speed, some shot pellets 7A opposed to and in contact with the disc 21 are thrust into the front end face 26 of the disc 21, due to the large inertial resistance mentioned above, whereby deep depressions 12A are formed in the front end face 26.

2) With regard to the other shot pellets 7B, 7C and 7D shown in FIG. 6, the shot pellet 7B is thrust between the shot pellets 7C and 7D, due to the inertial resistance thereof, and accordingly, the shot pellets 7C are moved in the radial direction thereof, whereby a deep depression 12B is formed in the internal surface 23 of the tube 22. On the other hand, the shot pellets 7D are also moved in the radial direction thereof (i.e., in the axial direction of the tube 22), and thus the shot pellets 7E adjacent to the shot pellets 7D come under a strong pressure imposed by the shot pellets 7D. Accordingly, the surface pressure at the portions of mutual contact between the shot pellets 7 is increased, and accordingly, the shot pellets 7 are strongly interconnected by a strong frictional force.

The movement of the shot pellets 7E causes a chain reaction movement of the adjacent shots 7, resulting in the formation of a depression 12B, in the inner peripheral surface 23 on the opposite side of the tube 2 to the depression 12B.

Figure 7:
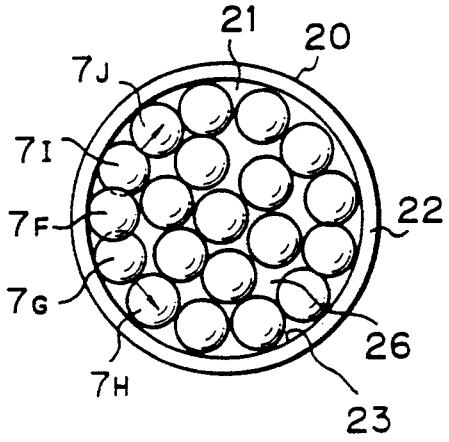
FIG. 7 is an explanatory end view of a container as from an open end thereof, in which one layer of shot pellets adjacent to a disc is particularly illustrated.

3) FIG. 7 shows a group of shot pellets 7 lying in a plane (layer) closest to the disc 21, as viewed from the open end side of the container 20. As can be seen in FIG. 7, the gap between the shot pellets 7G and 7I is very small, and thus the shot pellet 7F partially rides over the shot pellets 7G and 7I and is separated from the disc 21. When traveling through the barrel, the shot pellet 7F is thrust between the shot pellets 7G and 7I, due to the inertial resistance, and thus the shot pellets 7G and 7I are moved in the circumferential direction as shown by arrows. As a result, the surface contact pressures between the shot pellets 7G and 7I, and the respective adjacent shot pellets 7H and 7J, is increased, whereby the shot pellets 7 are firmly interconnected also in the circumferential direction.

4) The depths of the depressions formed in the internal surface 23 of the tube 22, and the mutual surface contact pressures between the shot pellets 7 are at a maximum in the vicinity of the disc 21 and become lower toward the front portion of the tube 22. Therefore, the force connecting the shot pellets 7 to the container 20 becomes lower toward the front portion of the tube 22. Namely, as shown in FIG. 6, depth of the depression 12B is larger than that of the depression 12C formed in the internal surface 23 of the tube 22 in the vicinity of the front open end of the container 20 (12B>12C). This is because the load imposed by the inertial resistance of the front shot pellets 7, i.e., at the open end of the container 20, on the adjacent shot pellets 7, at the rear of the container 20, increases in the same manner as water pressure increases with an increasing depth of the sea. This has been proved by depression patterns formed on the internal surfaces 23 of containers 20 recovered after firing.

As can be understood from the above, according to the present invention, since the shot pellets 7 are densely charged in the hollow portion 25 of the container 20 and are strongly pressed against one another, when the shot pellets 7 are fired from the muzzle of the barrel, they are interconnected and held in the container 20 due to a large number of depressions 12 and the mutual frictional contact force between the shot pellets 7. After leaving the muzzle of the barrel, the container 20 is forcibly decelerated by an air braking due to a form drag produced by the opposing air and the wave drag of the shock wave produced by the travel of the container 20 at a speed faster than the speed of sound, etc.

Since the shot pellets 7 have a large combined mass and a large inertia, they tend to travel at a constant speed, and the shot pellets 7 charged in the front portion of the container 20, and which have a relatively low mutual interconnecting force as discussed in item 4) above, first begin to separate from the container 20 and travel by themselves. Thereafter, the shot pellets 7 behind the front shot pellets 7 are separated from the container 20, since these shot pellets 7 behind the front shot pellets 7 are no longer restrained by the front shot pellets 7. Accordingly, a successive separation of the subsequent shot pellets 7 from the container 20 occurs until, finally, all of the shot pellets 7 are traveling separately from each other.

Assuming that the time at which the container 20 is fired from the muzzle is $T_0$, and the time at which all of the shot pellets 7 are separated from the container 20 is $T_1$, respectively, the time in which all of the shot pellets 7 are separated after being fired from the muzzle of the barrel, i.e., the separation time $T_L$, is given by the following equation;

$$T_L=(T_1-T_0)$$

The following discussion will be directed to the means for prolonging the separation time $T_L$.

The annular projection 24 (or 24A) is provided on the internal surface 23 the container 20 (or 20A) shown in FIG. 2 (or FIG. 3) to choke the open end of the container 20 (20A) to thereby restrain the exit of the shot pellets 7 therefrom, and accordingly, prolong the separation time $T_L$.

The additional annular projection 28 of the container 20A shown in FIG. 3 defines a stepped portion which restricts a forward movement of the shot pellets 7. Note, a plurality of annular projections 28 can be provided on the internal surface 23 of the tube 22A, with an appropriate distance therebetween in the axial direction, to enhance the restriction effect and thus further prolong the separation time $T_L$.

In the third embodiment shown in FIGS. 4 and 5, the ribs 29 and the post 30 contribute to an increase in the number of the depressions 12 formed not only on the inner peripheral surface 23 of the tube 22 but also on the surfaces of the ribs 29 and the post 30, so that the shot pellets 7 are more firmly connected to each other and to the container 20B. As discussed in items 2) and 3) above, since the shot pellets 7 are forcibly moved in the radial and the circumferential directions while traveling in the barrel 13, a large number of depressions 12 are formed on the surfaces of the ribs 29 and the post 30. These depressions 12 firmly hold the shot pellets 7 in the container 20B, together with the depressions 12 formed on the inner peripheral surface 23 of the tube 22, and thus the separation of the shot pellets 7 is further retarded, to thereby further prolong the above mentioned separation time $T_L$.

As stated above, a single projection or various projections having a combination of different shapes and different functions can be provided in the container 20 (20A, 20B) of the present invention, in accordance with need.

As mentioned above, a time $T_L$ must elapse before all of the shot pellets 7 are separated from the container 20 (20A, 20B) after being fired from the muzzle. On the other hand, the container 20 (20A, 20B) has the shot pellets 7 charged therein, and accordingly, the container has sufficient kinematic energy that it is not affected by the wind pressure resistance. Consequently, only a small deceleration of the container occurs, and thus the container, even after being fired from the muzzle, continues to travel at a transonic speed for a certain time. As a result, the container 20 (20A, 20B) flies farther toward a target, even within an extremely short space of a time $T_L$ on an order of, for example, $10^{-2}$ seconds, since the speed of travel of the container is very high. In general, the shot pellets 7 spread in a wider pattern as the flight distance thereof increases. In a shotshell using a container of the present invention, however, the spread of the shot pellets 7 begins with a certain time delay after the container has been fired from the muzzle, i.e., when the container and the shots have traveled a certain distance from the muzzle. Therefore, it is apparent that the pattern of the shotshell using the container of the present invention is denser than that of the conventional shotshell shown in FIG. 9.

Figure 8:
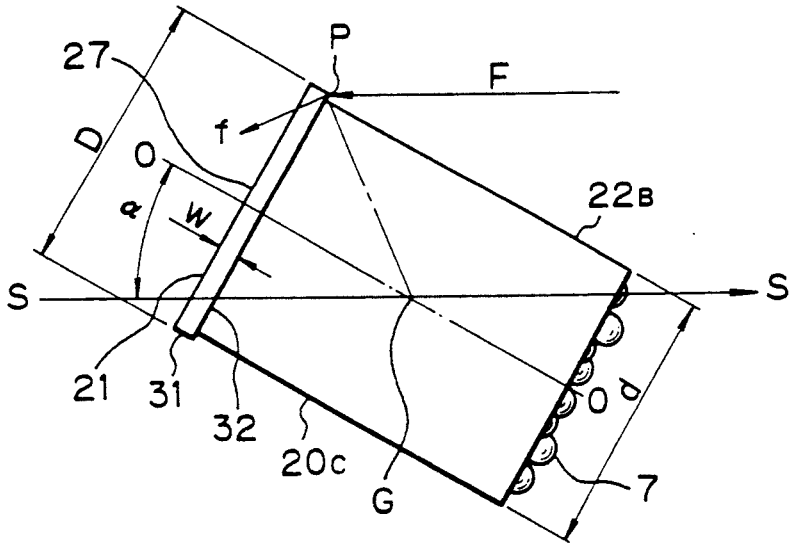
FIG. 8 is an explanatory view of an inclined container according to a fourth embodiment of the present invention, in which the inclination is exaggerated for clarification; and, FIG. 9 is a partially broken longitudinal sectional view of a known shotshell.

FIG. 8 shows a fourth embodiment of the present invention, in which the container 20C is equivalent to the container 20 of FIG. 2 but an annular flange 31 is additionally provided on the outer peripheral surface of the rear end of the container 20C coaxially with the disc 21 and integral with the container 20C. The outer diameter D of the annular flange 31 is substantially identical to the inner diameter of the bore 13A of the barrel 13 shown in FIG. 6, and the outer diameter d of the tube 22B is slight smaller than the bore diameter. Note, the width W of the annular flange 31 need not be always identical to the width (axial length) of the disc 21 of the container 20C. The remaining construction of the container 20C is identical to that of the container 20 shown in FIG. 2. Further note, a plurality of annular flanges 31 can be provided in the container 20C, spaced from one another at an appropriate axial distance.

As shown in FIG. 8, after being fired from the muzzle the container 20C is inclined with respect to the line of sight S—S at an inclination angle $\alpha$. Note, that the inclination angle $\alpha$ is exaggerated in FIG. 8, for clarification.

As also shown in FIG. 8, the center of gravity of the container 20C is located at a point G on the axis O—O, because of the weight of the shot pellets 7 charged in the container. Assuming that the relative wind resistance caused by the travel of the container 20C is represented by F, an end point P on the front face 32 of the annular flange 31 is subject to a component f of an aerodynamic force due to the relative wind resistance F in the direction perpendicular to the line segment PG connecting the points P and G. As a result, a restoration moment represented by "f(force)×line segment(moment arm)" is produced, and due to this restoration moment, the container 20C rotates in the counterclockwise direction about the center of gravity G until the axis O—O of the container matches the line of sight S—S. Namely, even if the container 20C is inclined with respect to the line of sight, it is automatically returned to the initial posture by the annular flange 31 serving as a stabilizer for stabilizing the flight posture of the container. The function of the stabilizer corresponds to a resultant function of a horizontal tail plane and a vertical tail plane of an aircraft. Therefore, the container 20C continues to fly, after being fired from the muzzle, while maintaining a correct posture, and accordingly, a uniform separation of the shot pellets from the container occurs, whereby an ideal circular shot pattern can be obtained.

Since there are no slits 10 (FIG. 9) in the container 20 (20A, 20B, or 20C) of the present invention, when passing through the barrel 13 no direct contact between the shot pellets 7 with the wall of the bore 13A occurs, and accordingly, the container of the invention can be advantageously used for a shotshell in which steel shot pellets, which are harder than the lead shot pellets, are charged.

The projection 24 (24A, 28, 29, 30) of the above mentioned embodiments constitutes a retarder for retarding the separation of the shot pellets from the container.

Figure 9:
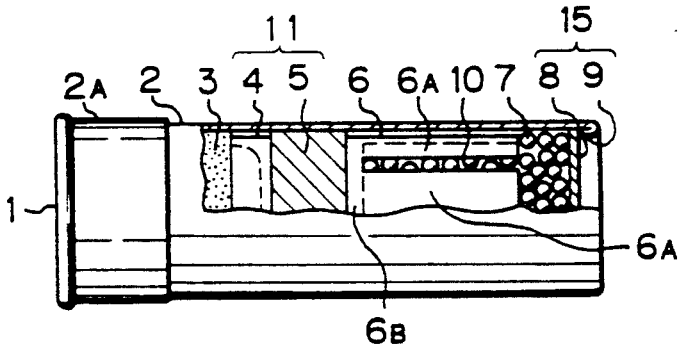
Fig. 9 (PRIOR ART)

Note, it is obvious that the container 20 (20A, 20B, 20C) of the first, second, third and fourth embodiments mentioned above can be made integral with the wad 11 shown in FIG. 9.

I claim:

1. In a shotshell for a shotgun, including a case in which powder, a wad, a container, and shot pellets contained in the container are charged in this order, the case being crimped at an open end thereof, wherein the container for containing the shot pellets comprises;

a container body comprised of a cylindrical tube and a disc integral therewith at a rear end of the tube and in contact with the wad, said disc being coaxial to the tube, said tube defining a completely closed circular loop at a front end as viewed from the front thereof, said disc and said tube having a diameter slightly smaller than a bore of an associated shotgun to be used, said container body being provided with an open hollow portion defined by an inner peripheral surface of the tube and an end face of the disc, said cylindrical tube being provided on an inner peripheral portion thereof with a plurality of ribs integral therewith which extend in parallel with a longitudinal axis of the container body, said container body being provided with a post coaxial thereto and integral therewith, which projects from the disc in the open hollow portion of the container body, said container body being made of plastics capable of being deformed when pressed by the shot pellets upon firing to automatically form a large number of depressions on the inner peripheral portion of the cylindrical tube, the ribs and the post, and, said shot pellets being interconnected and held to the container body due to the cooperation of the depressions and frictional force of the shot pellets acting therebetween to retard the time of separation of the shot pellets from the container.

* * * * *